United States Patent [19]

Aoki et al.

[11] Patent Number: 5,061,441

[45] Date of Patent: Oct. 29, 1991

[54] HIGHLY WEAR-RESISTANT ROLL STEEL FOR COLD ROLLING MILLS

[75] Inventors: Ken'ichi Aoki, Fujisawa; Yoshikazu Seino, Chiba; Teruhiro Saito, Chiba; Ken'ichi Tokoro, Chiba, all of Japan

[73] Assignees: Kawasaki Steel Corporation; Kanto Special Steel Works, Ltd., both of Japan

[21] Appl. No.: 509,043

[22] Filed: Apr. 13, 1990

[30] Foreign Application Priority Data

Apr. 21, 1989 [JP] Japan ..... 1-102169

[51] Int. Cl.[5] ..... C22C 38/28

[52] U.S. Cl. ..... 420/109; 420/110; 420/101; 420/68

[58] Field of Search ..... 420/109, 110, 111, 68, 420/100, 101

[56] References Cited

FOREIGN PATENT DOCUMENTS 132962 6/1965 Czechoslovakia .
346293 12/1989 European Pat. Off. .
897714 11/1953 Fed. Rep. of Germany .
59-143048 8/1964 Japan ..... 420/110
45-40778 12/1970 Japan ..... 420/109
171419 10/1965 U.S.S.R. .
583194 12/1977 U.S.S.R. .
1203779 9/1970 United Kingdom .

*Primary Examiner*—Deborah Yee
*Attorney, Agent, or Firm*—Daniel J. Hudak Co.

[57] ABSTRACT

A steel from which rolls for a cold rolling mill are made and which gives to the rolls very excellent wear resistance in addition to thermal shock and spalling resistances and various mechanical characteristics is provided. Said steel comprises:

C : 0.70 to 1.50 wt %
Si: 0.15 to 1.00 wt %
Mn: 0.15 to 1.50 wt %
Cr: 2.50 to 10.00 wt %
Mo: 1.00 wt % or less
V : 1.00 wt % or less
Ni: 1.00 wt % or less
Ti: 0.04 to 0.30 wt % with the balance being Fe and inevitable impurities.

1 Claim, 4 Drawing Sheets

HIGHLY WEAR-RESISTANT ROLL STEEL FOR COLD ROLLING MILLS

BACKGROUND OF THE INVENTION

1. Field of the Invention

The present invention relates to an alloy steel from which rolls of a cold rolling mill, in particular, work rolls are made. More specifically, the invention relates to a roll steel for rolls used in a cold rolling mill and this steel has extremely high wear resistance without any deterioration of resistance to thermal cracking, spalling resistance, and other mechanical characteristics.

2. Description of the Prior Art

As a prior steel from which rolls of a cold rolling mill, in particular, work rolls are made, the industry has adopted a kind of steel which contains 0.70 to 1.20 wt% of C, 0.15 to 1.00 wt% of Si, 0.15 to 1.00 wt% of Mn, 1.30 to 6.00 wt% of Cr, 0.20 to 0.50 wt% of Mo, and 0.40 wt% or less of V and has a Shore hardness (Hs) of 80 to 100. Recently, however, materials to be rolled become harder and the market trend is toward much thinner products This situation makes the rolling requirements severer, requiring the roll manufacturers to supply rolls with higher wear resistance.

To meet these requirements, the manufacturers tend to use high alloy materials to allow rolls of a cold rolling mill to have sufficiently high wear resistance in preference to other characteristics.

JIS SKD 11 steel, JIS SKH 57 steel, or improved roll steel derived therefrom are used to make rolls for Sendzimir or Cluster mills. If the roll diameter exceeds 300 mm, the manufacturing method thereof is under various restrictions. In addition, during rolling operation, the roll surface suffers many problems with its macroscopic or microscopic structure, including segregation associated with high alloying and coarse carbides dropped out of the surface. These problems are possible factors which may impair the surface of materials to be rolled.

SUMMARY OF THE INVENTION

The present invention provides, as a solution to those problems described above, a new and improved roll steel having high wear resistance equivalent to a cold die steel or high speed steel by minimizing an addition of alloying elements to the base made of some known kind of steel and adding a trace quantity of Ti to the base as substitutes therefor. The present steel offers all of the characteristics necessary for rolls used in a cold rolling mill.

The most important feature of the present invention is to add a trace quantity of Ti as a component to produce the present steel.

It is, therefore, an object of the present invention to provide a highly wear-resistant roll steel from which rolls of a cold rolling mill are made, comprising 0.70 to 1.50 wt% of C, 0.15 to 1.00 wt% of Si, 0.15 to 1.50 wt% of Mn, 2.50 to 10.00 wt% of Cr, 1.00 wt% or less of Mo, 1.00 wt% or less of V, 1.00 wt% or less of Ni, and 0.04 to 0.30 wt% of Ti with the balance being Fe and inevitable impurities.

DESCRIPTION OF THE PREFERRED EMBODIMENTS

Figure 1:
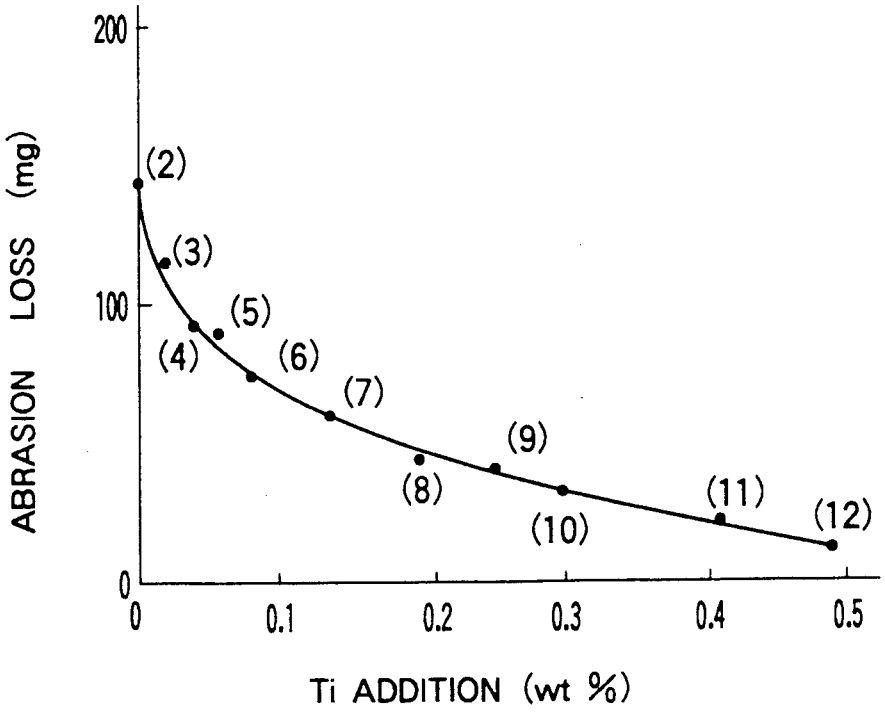
FIG. 1 is a graph showing a relationship between Ti addition and abrasion loss and the numbers in parentheses are the sample numbers listed in Table 1 described later.

Now the components and their contents of the present roll steel are described below together with the reasons why the present inventors have adopted them.

(1) C: 0.70 to 1.50 wt%

C is an element which may affect most in giving to the present steel a hardness, one of the basic characteristics required for rolls used in a cold rolling mill. Less than 0.70 wt% of C provides an insufficient hardness for the material and more than 1.50 wt% of C deteriorates markedly the mechanical characteristics thereof. Thus, the inventors have adopted the C content, 0.70 to 1.50 wt%.

(2) Si: 0.15 to 1.00 wt%

Si usually acts as a deoxidizing element and is effective to improve hardenability and cracking resistance of the steel. Excess addition of the element, however, may impair the cleanliness of the steel due to deoxidation products and reduce the toughness. Thus, the inventors have adopted the Si content, 0.15 to 1 00 wt%.

(3) Mn: 0.15 to 1.50 wt%

Mn is a deoxidizing element like Si and has remarkable effects on improvement of hardenability. Excess addition of the element, however, may greatly drop the Ms point, increasing the quenching crack susceptibility. Thus, the inventors have adopted the Mn content, 0.15 to 1.50 wt%.

(4) Cr: 2.50 to 10.00 wt%

Cr has effects on improvement of not only tempering resistance but wear resistance by producing carbides of $M_7C_3$ and $M_3C_2$ types. The former is a fine carbide and the latter is coarse and greatly reduces the toughness. To prevent the latter from forming, it is necessary to select an appropriate ratio of Cr/C, for example, approximately 6. Thus, the inventors have adopted the upper limit of Cr content, 10.00 wt%, with that of the C content, 1.50 wt%.

(5) Mo: 1.00 wt% or less

Mo has remarkable effects on improvement of wear and tempering resistances, but more than 1 wt% of Mo may markedly deteriorate the mechanical properties and the heat treatment of the steel may be under some restrictions. In addition, Mo is expensive and may raise the production cost for rolls of a cold rolling mill when their diameters exceed 300 mm. Thus, the inventors have adopted the upper limit of Mo content, 1.00 wt%.

(6) V: 1.00 wt% or less

V, like Mo, has remarkable effects on improvement of wear resistance but more than 1 wt% of V may adversely affect the grindability of the roll. Its economic aspect has also caused the inventors to adopt the upper limit of V content, 1.00 wt%.

(7) Ni: 1.00 wt% or less

Ni is an important element to improve the hardenability. A proper amount of Ni must be added depending on the hardness penetration required for the roll, but more than 1.00 wt% of Ni may increase the retained austenite and cause fine dents on the roll surface. Thus, the inventors have adopted the upper limit of Ni content, 1.00 wt%.

(8) Ti: 0.04 to 0.30 wt%

Ti is the most important element for the present invention and is closely related to the characteristics required to achieve the object of the present invention. Therefore, this element and its content the inventors have adopted are described below in detail.

First, the significance of adding Ti to form the present steel is described.

The roll steels each having the components as shown in Table 1 were examined on various characteristics through several experiments. The experimental results are shown in FIGS. 1 through 4.

TABLE 1

| | Chemical composition of samples (wt %) | | | | | | | | | |
|---|---|---|---|---|---|---|---|---|---|---|
| No. | C | Si | Mn | P | S | Ni | Cr | Mo | V | Ti |
| 1 | 0.84 | 0.35 | 0.41 | 0.013 | 0.005 | 0.12 | 3.02 | 0.25 | 0.07 | — |
| 2 | 0.87 | 0.37 | 0.42 | 0.019 | 0.004 | 0.11 | 5.03 | 0.26 | 0.07 | — |
| 3 | 0.84 | 0.36 | 0.40 | 0.017 | 0.008 | 0.13 | 4.98 | 0.23 | 0.06 | 0.03 |
| 4 | 0.86 | 0.35 | 0.40 | 0.015 | 0.007 | 0.10 | 5.05 | 0.25 | 0.08 | 0.04 |
| 5 | 0.86 | 0.34 | 0.39 | 0.012 | 0.006 | 0.10 | 4.95 | 0.25 | 0.05 | 0.06 |
| 6 | 0.85 | 0.36 | 0.44 | 0.015 | 0.004 | 0.12 | 4.96 | 0.24 | 0.06 | 0.08 |
| 7 | 0.85 | 0.35 | 0.42 | 0.017 | 0.005 | 0.13 | 4.98 | 0.23 | 0.06 | 0.13 |
| 8 | 0.84 | 0.34 | 0.45 | 0.022 | 0.008 | 0.11 | 5.03 | 0.22 | 0.06 | 0.19 |
| 9 | 0.85 | 0.37 | 0.42 | 0.019 | 0.006 | 0.10 | 5.10 | 0.21 | 0.05 | 0.25 |
| 10 | 0.88 | 0.31 | 0.43 | 0.014 | 0.005 | 0.10 | 4.97 | 0.26 | 0.05 | 0.30 |
| 11 | 0.85 | 0.35 | 0.44 | 0.013 | 0.004 | 0.14 | 4.99 | 0.25 | 0.07 | 0.42 |
| 12 | 0.86 | 0.33 | 0.45 | 0.016 | 0.007 | 0.12 | 5.01 | 0.25 | 0.06 | 0.49 |

In the table, Nos. 1 and 2 samples are the prior arts, each having typical components as a material from which rolls for a cold rolling mill are made. Nos. 3 to 10 samples are the present roll steels and Nos. 11 and 12 samples are comparisons.

FIG. 1 is a graph showing a relationship between Ti addition and abrasion loss. Each sample was hardened and tempered to have an approximately HRC 63 hardness and then rubbed by an endless sanded belt type grinder under a pressure for a certain period. Abrasion losses (mg/cm$^2$) of those samples were measured and the wear resistance of each sample was compared with others. In the figure, the numbers in parentheses are the sample numbers.

From the figure, less than 0.04 wt% of Ti does not provide so large effects on the wear resistance but 0.04 wt% or more provides higher wear resistances than the prior arts. Around 0.15 wt% of Ti provides the wear resistance 3 times as high as that of the prior art which contains 5 wt% of Cr. This improvement of wear resistance is achieved by production of a very hard carbide TiC, which is dispersed finely and uniformly in the sample steel. However, more than 0.30 wt% of Ti causes segregation of TiC and reduction in grindability of the roll, preventing industrial applications of the steel. Thus, the upper limit of Ti content has been determined 0.30 wt%.

Figure 2:
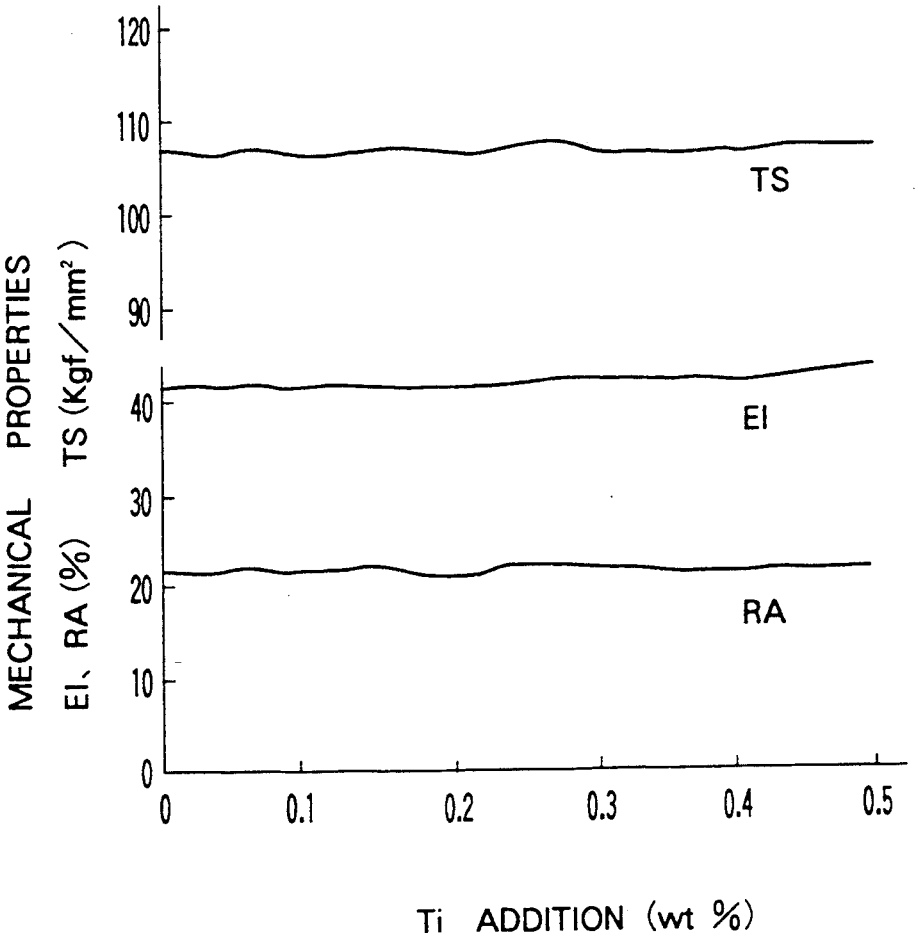
FIG. 2 is a graph showing relationships between Ti addition and mechanical properties and T.S, El and RA represent tensile strength (kgf/mm$^2$), elongation (%), and reduction of area (%), respectively.

FIG. 2 is a graph showing relationships between Ti addition and mechanical properties. Each sample in Table 1 was hardened and tempered to have a HRC 32 hardness and its mechanical properties, that is, tensile strength (T.S, kgf/mm$^2$), elongation (El, %), and reduction of area (RA, %) were determined by tensile testing and compared with others.

As shown in FIG. 2, a Ti addition of 0.04 to to 0.30 wt% produces little variation in tensile strengh, elongation, and reduction of area.

The prior steels have been developed by adding a large quantity of Mo, V, W, and other alloying elements to provide higher wear resistance. This large addition of alloying elements greatly reduces the mechanical properties and the prior rolls for a cold rolling mill, which are required to have a high hardness, cannot be heat-treated enough if their barrel diameters exceed 300 mm.

The present steel, however, contains a trace quantity of Ti, which improves the wear resistance remarkably as shown in FIG. 1 without any adverse effect on the mechanical properties.

The present invention will be understood more readily by reference to the following examples in which several rolls made from the present steel are applied to a rolling mill in service. However, these examples are intended to illustrate the invention and are not to be construed to limit the scope of the invention.

EXAMPLES

A steel having the compositions similar to those of Nos. 5 and 6 samples in Table 1 was used to make work rolls for a cold tandem mill which rolls tin plates and the rolls were applied to the mill. The barrel diameter of each roll was 610 mm.

The rolls were used at the No. 6 final stand for rolling tin plates. The experimental rolling results were compared with those of the prior art containing 5 wt% of Cr and shown in Table 2 and FIGS. 3 and 4.

TABLE 2

| Consumption per unit production of present invention and prior art (5 wt % of Cr) | |
|---|---|
| Roll type | Consumption per unit production |
| Present invention | 0.06 mm/1000 t |
| Prior art | 0.35 mm/1000 t |

Note: The rolls were only used at the final stand of a tandem mill for tin plate rolling and the consumption per unit production was calculated on rolls which were replaced when they showed a certain level of wear due to normal operation.

Table 2 shows roll consumptions per unit production of the present invention containing Ti and the prior art comprising a 5 % Cr steel. For purpose of this specification, the consumption per unit production means a roll consumption caused by rolling 1000 t of products at the final stand. As shown in the table, the present invention exhibits a much lower roll consumptions, that is, approximately one sixth of what the prior art does.

Generally, rolls for a cold rolling mill must be ground to make the surface have a certain roughness before applied to rolling operation. Moreover, it is important to prevent the initial roughness from deteriorating during the rolling operation.

Figure 3:
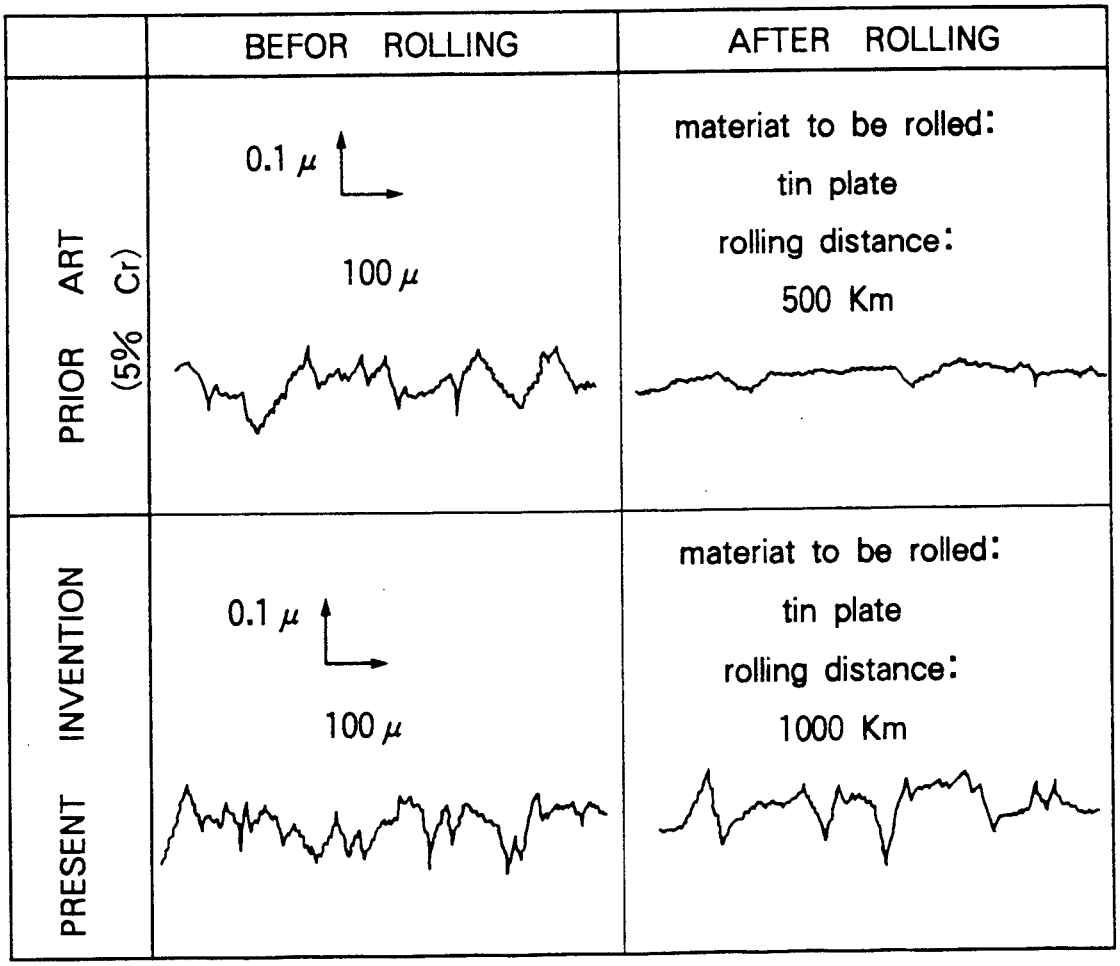
FIG. 3 shows profiles for comparison of the surface roughness of the present and prior rolls before rolling with that of the rolls after rolling.

FIG. 3 shows profiles for comparison of the surface roughness of the present and prior rolls before rolling with that of the rolls after rolling.

The rolls made from the present steel did not show a large difference in surface roughness between before and after the rolling even if they rolled twice (in amount) what the prior rolls did.

The surface roughness of rolls is closely related to the friction coefficient. The friction coefficient is also a factor which affects stable rolling operation. When a friction coefficient between a roll and cold strip is 0.015 or less, the rolling operation usually becomes unstable, resulting in slip or wreck accidents. To avoid them, the rolls must be replaced when the friction coefficient drops to some level.

Figure 4A:
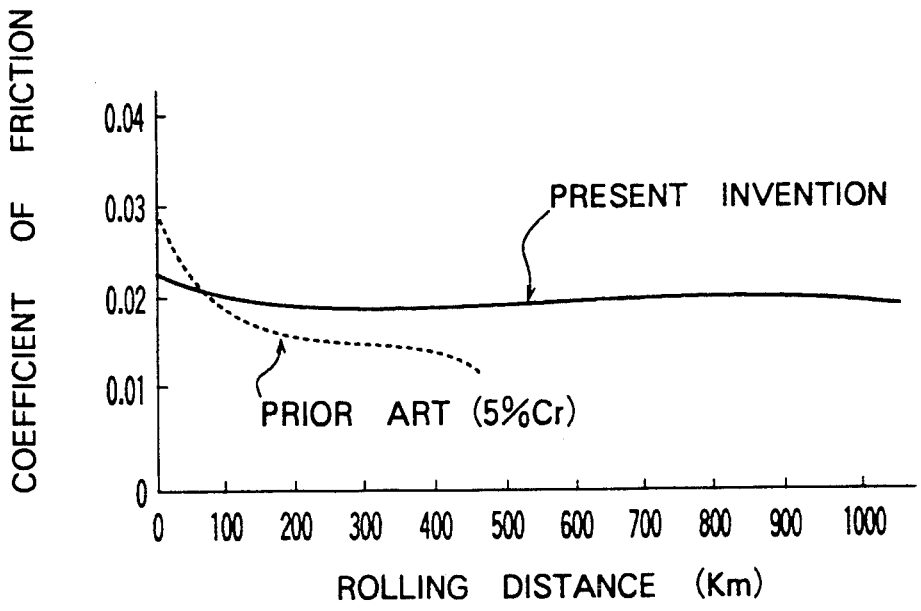
FIG. 4(*a*) is a graph showing relationships between rolling distance and friction coefficient and FIG. 4(*b*) is a graph showing relationships between rolling distance and rolling speed. In those graphs, the solid line shows the present rolls and the dotted line shows the prior rolls.
Figure 4B:
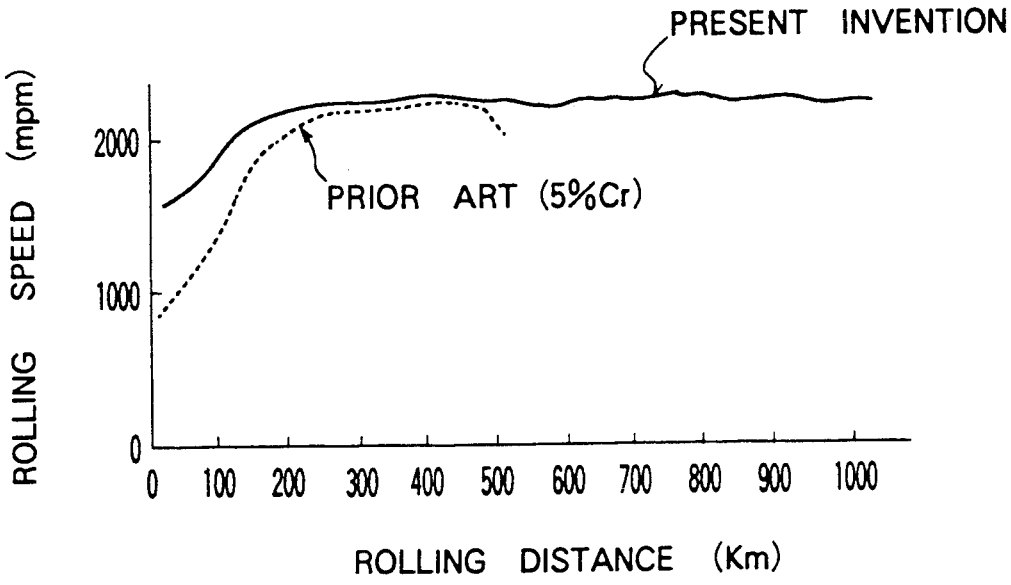

FIG. 4 shows relationships between rolling distance and friction coefficient [FIG. 4(*a*)] and those between rolling distance and rolling speed [FIG. 4(*b*)].

As may be seen from FIG. 4(*a*), the present rolls continued to have a friction coefficient of approximately 0.02 throughout the rolling, indicating that the rolls kept much stabler than the prior rolls and that they can make a great contribution to the rolling operation.

In addition, the present rolls exhibit a much smaller drop in initial friction coefficient (initial griding roughness) at a rolling distance of 0 to 100 km as compared with the prior rolls. Therefore it is possible to make initial grinding roughness of rolls after the roll replacement small and make friction coefficient small. (more than 0.015). Then it is possible to make rolling separate force low.

Thus, low initial rolling separate force permits a high rolling speed immediately after the roll replacement as shown in FIG. 4(*b*).

It should be noted that the practical experiments mentioned above were made with the rolls installed on the final No. 6 stand of a tandem mill and that the friction coefficients were calculated with the Bland and Ford's equation.

Those excellent results obtained from the present rolls installed on the practical mill are based on their high wear resistance, which may have large industrial influence.

As many apparently widely different embodiments of this invention may be made without departing from the spirit and scope thereof, it is to be understood that the invention is not limited to the specific embodiments thereof except as defined in the appended claims.

What is claimed is:

1. A highly wear-resistant roll steel from which rolls of a cold rolling mill are made, comprising:

C: 0.70 TO 1.50 wt%
Si: 0.5 to 0.37 wt%
Mn: 0.15 to 0.45 wt%
Cr: 2.50 to 10.00 wt%
Mo: less than 0.26 wt%
V: less than 0.08 wt%
Ni: 1.00 wt% or less
Ti: 0.04 to 0.30 wt% with the balance being Fe and inevitable impurities.

* * * * *

UNITED STATES PATENT AND TRADEMARK OFFICE

CERTIFICATE OF CORRECTION

PATENT NO. : 5,061,441

DATED : 10/29/91

INVENTOR(S) : Aoki, Ken'ichi et al.

It is certified that error appears in the above-identified patent and that said Letters Patent is hereby corrected as shown below:

In Claim 1, Col. 6, line 24, delete "0.5" and substitute therefor --0.15--.

Signed and Sealed this

Nineteenth Day of April, 1994

Bruce Lehman

BRUCE LEHMAN

*Commissioner of Patents and Trademarks*

*Attest:*

*Attesting Officer*